US006725905B2

(12) United States Patent
Hirano et al.

(10) Patent No.: US 6,725,905 B2
(45) Date of Patent: Apr. 27, 2004

(54) RADIATOR UNIT FOR ENGINE AND METHOD OF COMBINING THE SAME WITH ENGINE

(75) Inventors: Michio Hirano, Akashi (JP); Tetsuaki Shirai, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 128 days.

(21) Appl. No.: 09/934,484

(22) Filed: Aug. 23, 2001

(65) Prior Publication Data

US 2002/0023731 A1 Feb. 28, 2002

(30) Foreign Application Priority Data

Aug. 30, 2000 (JP) ..... 2000-261180

(51) Int. Cl.[7] ..... F01P 3/18; B60K 11/04

(52) U.S. Cl. ..... 165/51; 165/121; 180/68.4

(58) Field of Search ..... 180/68.4; 165/41, 165/42, 43, 51, 67, 69, 122, 121

(56) References Cited

U.S. PATENT DOCUMENTS

| | | | | | |
|---|---|---|---|---|---|
| 4,519,467 | A | * | 5/1985 | Saunders | 180/68.4 |
| 4,770,234 | A | * | 9/1988 | Hiraoka et al. | 165/69 |
| 5,042,568 | A | * | 8/1991 | Fehlhafer | 165/69 X |
| 5,219,016 | A | * | 6/1993 | Bolton et al. | 165/69 X |
| 5,605,200 | A | * | 2/1997 | Mayberry et al. | 180/68.4 |
| 5,960,899 | A | * | 10/1999 | Roach | 180/68.4 |
| 6,073,594 | A | * | 6/2000 | Tsukiana et al. | 123/41.33 |
| 6,260,609 | B1 | * | 7/2001 | Takahashi | 165/69 |
| 6,408,933 | B2 | * | 6/2002 | Fukuoka et al. | 165/69 X |
| 6,499,956 | B2 | * | 12/2002 | Nakamura | |
| 6,550,558 | B2 | * | 4/2003 | Yorwath et al. | 165/69 X |

FOREIGN PATENT DOCUMENTS

| | | | | |
|---|---|---|---|---|
| CA | 682080 | * | 6/1961 | 165/69 |
| JP | 58-18099 | | 7/1983 | |
| JP | 03-057816 | | 3/1991 | |
| JP | 3-84397 | * | 4/1991 | 165/69 |
| JP | 4-129825 | * | 4/1992 | 165/69 |
| JP | 08-177494 | | 7/1996 | |

* cited by examiner

*Primary Examiner*—Ljiljana Ciric
(74) *Attorney, Agent, or Firm*—Oliff & Berridge, PLC

(57) ABSTRACT

A radiator unit (10) includes a radiator core (14) and a fan shroud (16) surrounding a cooling fan (15). Radiator support members (40) are attached to an engine (1), lower end parts of the radiator core (14) are connected to lower positioning lugs (46) formed in the radiator support members (40) by plug-in structures each including a positioning pin (32) and the positioning lug (46) provided with a positioning hole (53), and upper end parts of the radiator core (14) are fastened to radiator holding lugs (45) formed in upper end parts of the radiator support members (40) with bolts (56). The fan shroud (16) is fastened together with the radiator core (14) to the radiator support members (40). An intake duct (25) connected to the air inlet (23) of an air cleaner (5) is formed integrally with the fan shroud (16).

7 Claims, 7 Drawing Sheets

RADIATOR UNIT FOR ENGINE AND METHOD OF COMBINING THE SAME WITH ENGINE

BACKGROUND OF THE INVENTION

1. Field of the Invention

The present invention relates to a radiator unit for an internal combustion engine and, more particularly, to a radiator unit to be used in combination with a cooling fan included in an internal combustion engine and a method of combining the same with the engine.

2. Description of the Related Art

A conventional radiator unit for an automotive internal combustion engine (hereinafter referred to simply as "engine") has a radiator core mounted on a car body, and a fan shroud attached to the radiator core so as to surround a cooling fan mounted on the engine.

When shipping a general-purpose liquid-cooled engine, the liquid-cooled engine is not provided with any radiator unit in most cases. If the user desires, a radiator unit as an option is combined with the liquid-cooled engine before shipping the liquid-cooled engine.

In an engine provided with a radiator unit 10 as shown in FIG. 7, a radiator core 102 is fixedly provided with a fan shroud 101 surrounding a cooling fan 100, and the radiator core 102 is fixed on the engine via upper and lower brackets (not shown) with bolts. An L-shaped intake duct 110 is connected to the air inlet 106 of an air cleaner 105.

Combining the radiator unit 10 with the engine with the bolts as shown in FIG. 7 takes much time and labor because the heavy radiator core 102 must be positioned so that an appropriate clearance is formed between the fan shroud 101 attached to the radiator core 102, and the fan 100. Further, since the fan shroud 101 is attached directly to the radiator core 102, the fan shroud 101 vibrates together with the heavy radiator core 102. Consequently, the position of the fan shroud 101 relative to the cooling fan 100 mounted on the engine changes, noise may be generated or the fan shroud 101 may come into contact with the cooling fan 100.

In many cases, as shown in FIG. 7, the intake duct 110 connected to the air inlet 106 of the air cleaner 105 is opened toward the front side of the radiator unit 10 to take in not heated air. In this case, it is desirable that the intake duct 110 is extended so as to avoid the radiator unit 10 and to extend toward the front side of the radiator unit 10. Thus, the intake duct 110 extends beyond the radiator unit 10, which increases the outside dimensions of the engine.

SUMMARY OF THE INVENTION

The present invention has been made in view of such problems and it is therefore an object of the present invention to provide a radiator unit having a radiator core and a fan shroud capable of being easily attached to and detached from an engine and of enabling an intake duct to open toward the front side of the radiator core without increasing the outside dimensions of the engine.

According to a first aspect of the present invention, a radiator unit to be used in combination with a cooling fan mounted on an engine includes a radiator support member attached to the engine; and a radiator core fastened to the radiator support member; wherein a lower end part of the radiator core is connected to a lower end part of the radiator support member by a plug-in structure including a positioning pin provided on the lower end part of the radiator core and a positioning hole of a positioning lug provided in the radiator support member, and an upper end part of the radiator core is fastened to an upper end part of the radiator support member.

Preferably, the radiator unit according to the first aspect of the present invention further includes a fan shroud attached to the radiator support member so as to surround the cooling fan. Preferably, an intake duct connected to the air inlet of an air cleaner mounted on the engine is formed integrally with the fan shroud.

Preferably, the lower end part of the radiator core is connected to the lower end part of the radiator support member through a damping member. Also, it is preferable that the upper end part of the radiator core is connected to the upper end part of the radiator support member through a damping member.

According to a second aspect of the present invention, a radiator unit to be used in combination with a cooling fan mounted on an engine includes a radiator support member attached to the engine; a radiator core fastened to the radiator support member; and a fan shroud attached to the radiator support member so as to surround the cooling fan; wherein an intake duct connected to the air inlet of an air cleaner mounted on the engine is formed integrally with the fan shroud.

According to a third aspect of the present invention, a radiator-engine combining method of combining a radiator unit with an engine includes the steps of fastening a radiator support member to the engine; attaching a fan shroud to the radiator support member so as to surround a cooling fan mounted on the engine; and attaching a radiator core to the radiator support member by connecting a lower end part of the radiator core to a lower end part of the radiator support member by a plug-in structure including a positioning pin provided on the lower end part of the radiator core and a positioning hole of a positioning lug provided in the radiator support member, and fastening an upper end part of the radiator core to an upper end part of the radiator support member with a bolt.

Preferably, the step of attaching the fan shroud to the radiator support member of the method according to the third aspect of the present invention connects an intake duct formed integrally with the fan shroud to the air inlet of an air cleaner mounted on the engine.

According to the first and the third aspect of the present invention, the radiator support member is fixed to the engine, the lower end part of the radiator unit is engaged with the lower end part of the radiator support member by the plug-in structure including the pin and the positioning lug and the upper end of the radiator unit is fastened to the upper end part of the radiator support member with the bolt. Thus, the radiator core can be easily positioned, only the upper end part of the radiator unit needs to be fastened to the radiator support member with the bolt and hence the radiator can be easily combined with the engine.

According to the first and the second aspect of the present invention, the fan shroud for surrounding the cooling fan mounted on the engine is not fixed directly to the radiator core and is fixed individually to the radiator support member attached to the engine. Thus, the fan shroud can be easily positioned and fixed to the radiator support member such that an appropriate clearance is maintained between the fan shroud and the cooling fan. Since the clearance between the fan shroud and the cooling fan remains constant even if the heavy radiator core vibrates, noise will not be generated and the cooling fan will not touch the fan shroud.

According to the first to the third aspect of the present invention, the intake duct connected to the air inlet of the air cleaner is formed integrally with the fan shroud that is fastened to the radiator support member supporting the radiator unit, so that the number of parts can be reduced, the fan shroud and the intake duct can be simultaneously mounted on the engine and work for assembling the engine is simplified. Since the fan shroud is formed integrally with the intake duct, the intake duct can be easily disposed close to the periphery of the radiator core and can be extended to the front side of the radiator unit without increasing the outside dimensions of the engine.

DESCRIPTION OF THE PREFERRED EMBODIMENTS

Figure 1:
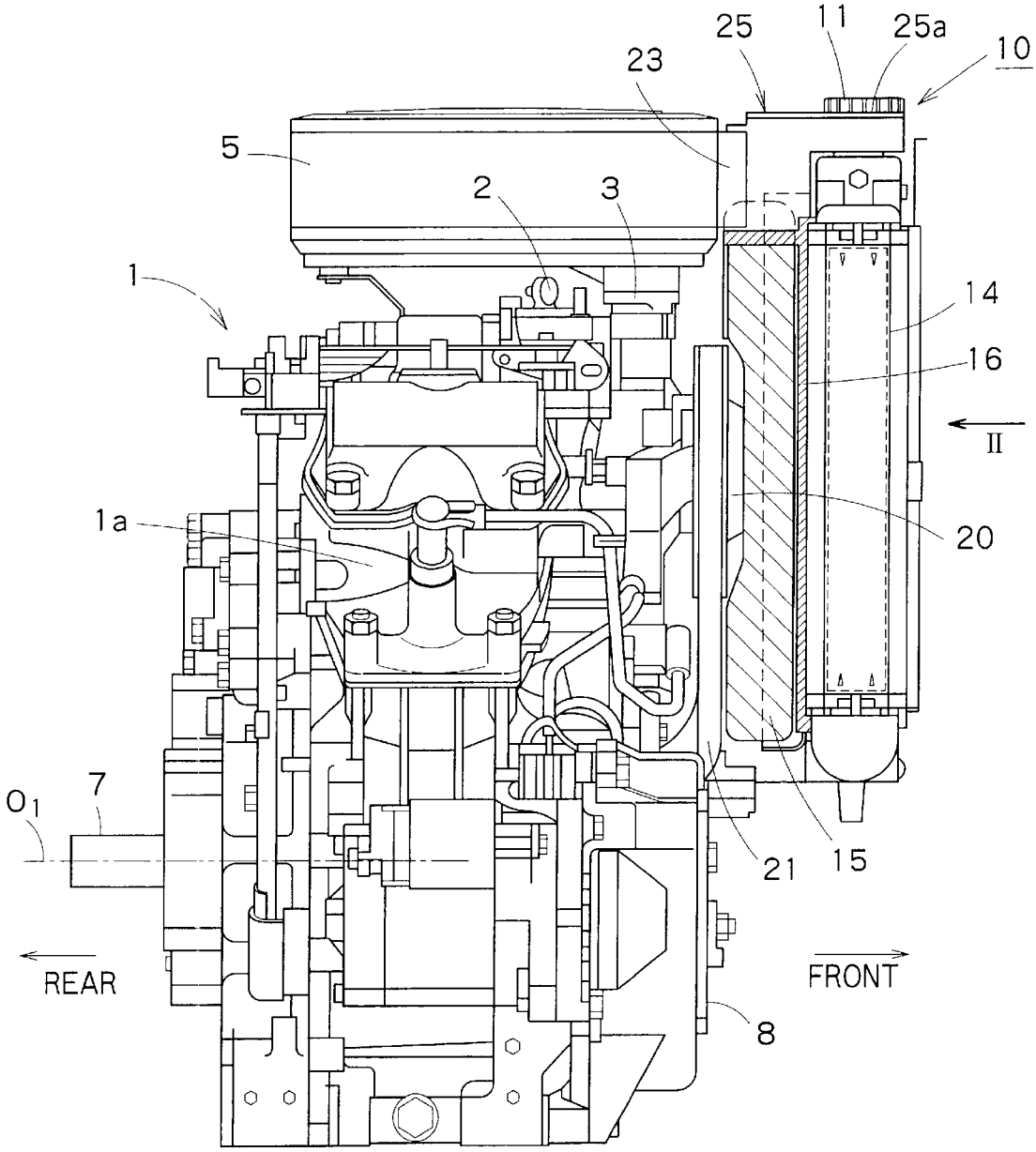
FIG. 1 is a partly sectional side elevation of an engine provided with a radiator unit in a preferred embodiment of the present invention.

Referring to FIG. 1 showing a two-cylinder V-engine 1 provided with a radiator unit in a preferred embodiment of the present invention, the engine 1 has two cylinders l*a* arranged in two banks, a carburetor 2 disposed between the two cylinders 1*a*, and an air cleaner 5 disposed above and connected to the carburetor 2 by an intake pipe 3. An output shaft 7 having an axis $O_1$ and coaxial with a crankshaft projects rearward from a rear end of the engine 1. A flywheel 8 is disposed on the front side of the engine 1. A radiator unit 10 is disposed on the front side of the engine 1. The radiator unit 10 is disposed above the axis $O_1$. The upper surface of a filler cap 11 on an upper end part of the radiator unit 10 is substantially flush with the upper end of the air cleaner 5. The radiator unit 10 essentially comprises a radiator core 14 provided with cooling water pipes, and a fan shroud 16 surrounding a cooing fan 15 (represented by a shaped area) disposed behind the radiator core 14. Fresh air flows from the front surface of the radiator core 14 through the radiator core 14 and flows toward the engine 1. The cooling fan 15 is fixedly mounted on a shaft 20 provided with a pulley and supported by the engine body. The pulley mounted on the shaft 20 is connected by a fan belt 21, i.e., a power transmitting member, to a pulley mounted on the crankshaft.

A cylindrical air inlet pipe 23 is formed on a front end part of the air cleaner 5. The air inlet pipe 23 is disposed above the fan shroud 16 and opens forward. An intake duct 25 formed of a resin integrally with the fan shroud 16 and extending toward the front is connected to the intake pipe 23. The intake duct 25 has a cylindrical part extending over the cooling fan 15 and a flat part 25*a* extending over the radiator core 14. The front end of the intake duct 25 lies above the front end of the radiator core 14 and opens toward the front.

Figure 2:
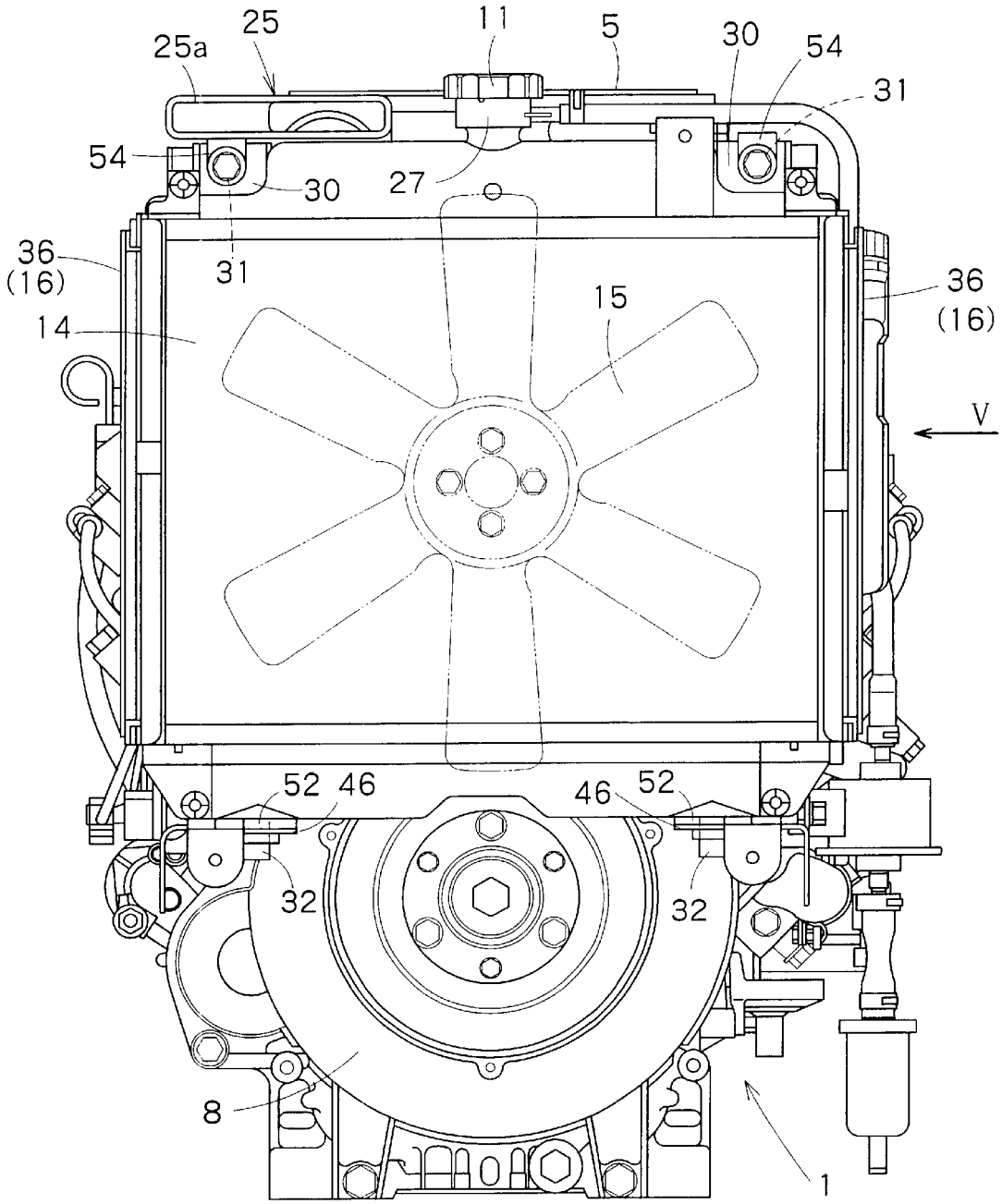
FIG. 2 is a front elevation of the engine shown in FIG. 1.

Referring to FIG. 2 showing the engine shown in FIG. 1 in a front elevation, the radiator core 14 is provided in a middle part of its upper end wall with a cooling water filler tube 27. The flat part 25*a* of the air intake duct 25 is disposed beside the cooling water filler tube 27. The upper surface of the flat part 25*a* of the air intake duct 25 is substantially flush with the upper surface of the air cleaner 5 and is on a level below a plane including the upper surface of the filler cap 11 put on the cooling water filler tube 27. A pair of upper mounting plates 30 each provided with a hole 31 are fixed to the upper end wall of the radiator core 14. Positioning pins 32 project downward from right and left end parts of the lower end wall of the radiator core 14.

Figure 3:
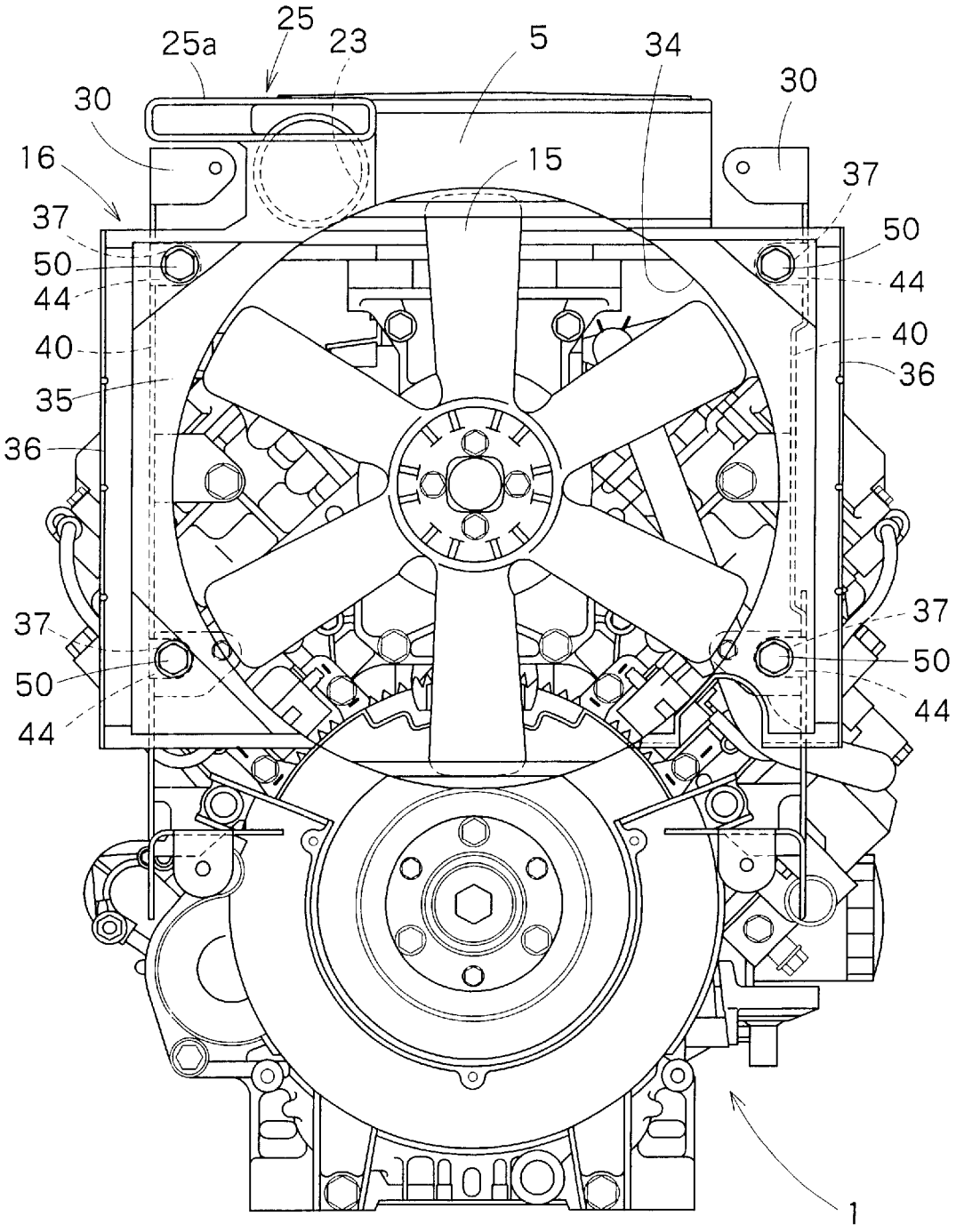
FIG. 3 is a front elevation of the engine shown in FIG. 1 in a state where a radiator core is removed.
Figure 6:
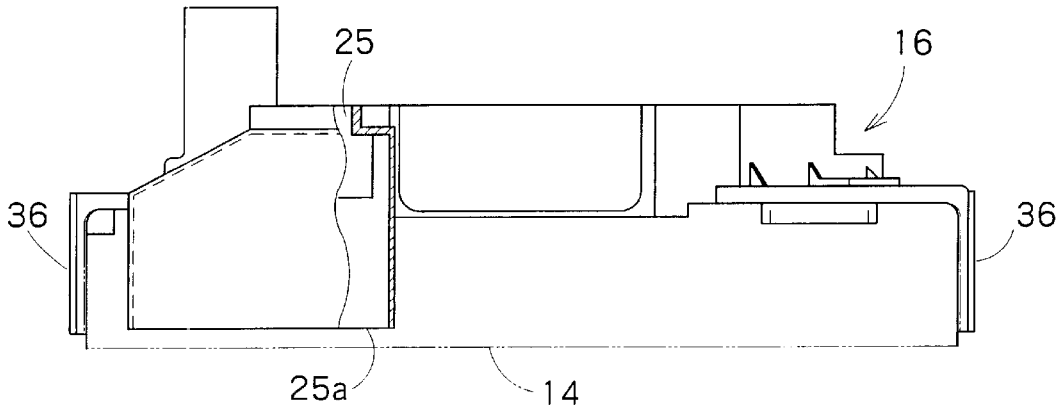
FIG. 6 is a plan view of the fan shroud shown in FIGS. 1 and 2.
Figure 7:
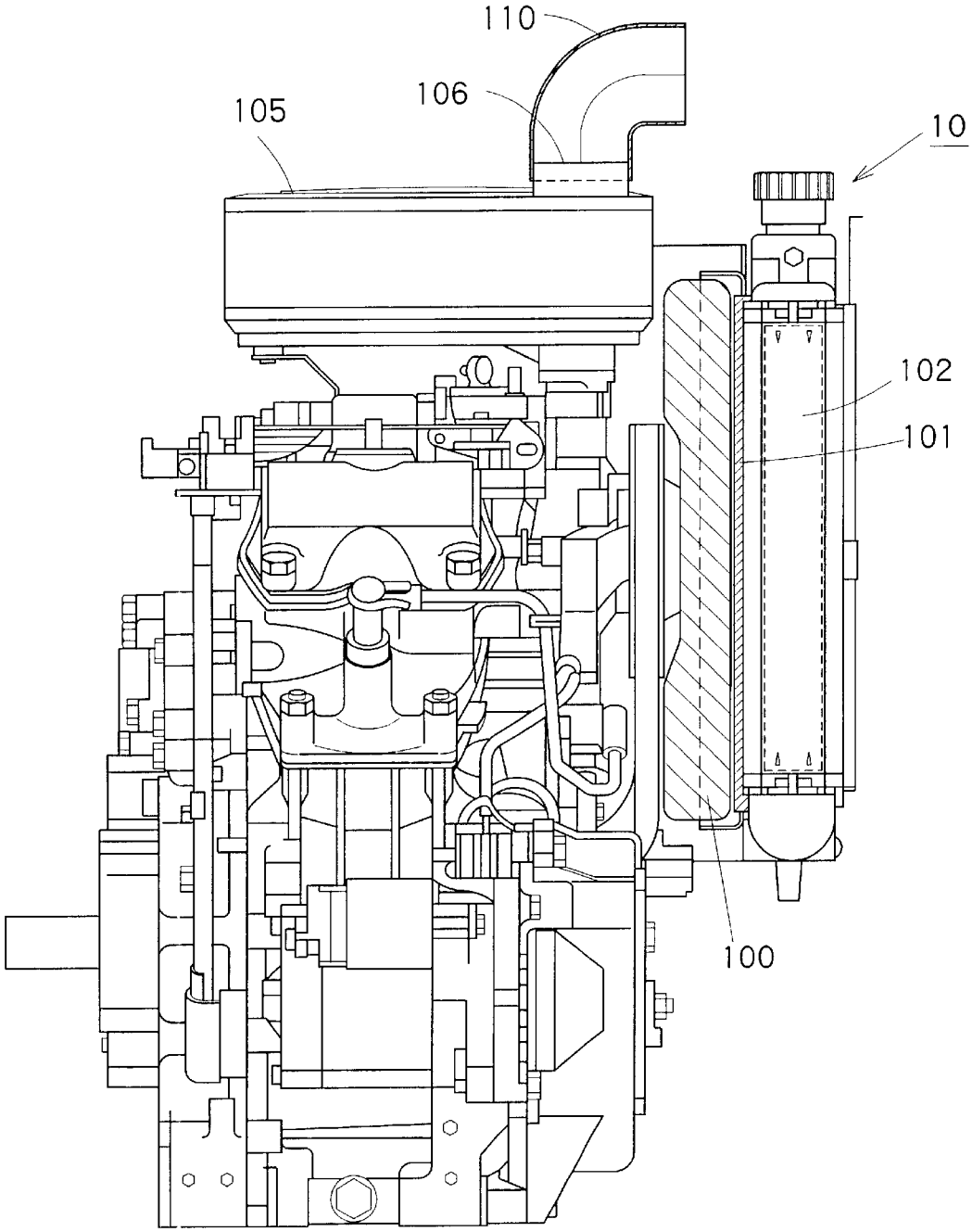
FIG. 7 is a side elevation of an engine of assistance in explaining a method of combining a conventional radiator with an engine.

Referring to FIG. 3 showing the engine shown in FIG. 1 in a front elevation, the fan shroud 16 has a cylindrical part 34 surrounding the cooling fan 15 so that a small clearance is formed between the cylindrical part 34 and an imaginary cylinder circumscribing the cooling fan 15, a rectangular mounting wall 35, and right and left side walls 36 on the right and the left side of the mounting wall 35. The air intake duct 25 is formed integrally with the fan shroud 16. The mounting wall 35 is provided in its four corners with holes 37. As shown in FIG. 6, the sidewalls 36 extend forward on the opposite sides of the radiator core 14, respectively.

Figure 4:
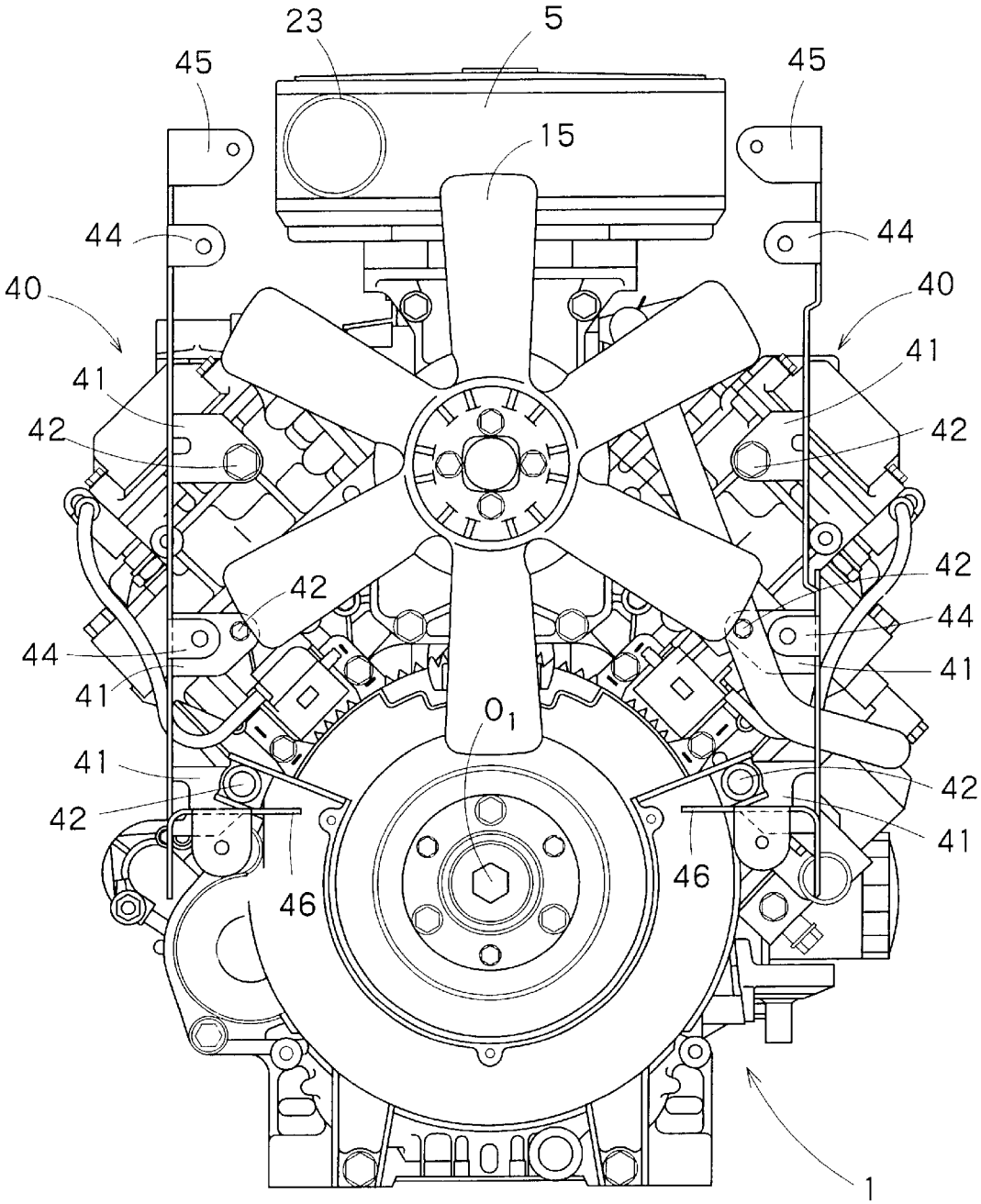
FIG. 4 is a front elevation of the engine shown in FIG. 1 in a state where the radiator core and a fan shroud are removed.

FIG. 4 shows the engine shown in FIG. 1 in a state where the radiator core 14 and the fan shroud 16 are removed, in which a pair of radiator support members 40 are clearly shown in a front elevation. The pair of radiator support members 40 are disposed on the right and the left side, respectively, in front of the engine 1. The lower ends of the radiator support members 40 are substantially on the same level as the axis $O_1$ of the output shaft 7, and the upper ends of the radiator support members 40 are substantially on the level of the middle with respect to height of the air cleaner 5.

Three attaching lugs 41 are formed on the rear end of each of the radiator support members 40 and are fastened to the front end of the engine 1 with bolts 42. A pair of fan shroud holding lugs 44 for holding the fan shroud 16 are formed at an upper and a lower part of the front end of each of the radiator support members 40. Radiator holding lugs 45 are formed at upper end parts of the radiator support members 40. Positioning lugs 46 for positing the radiator core 14 are formed horizontally at front lower end parts of the radiator support members 40.

Figure 5:
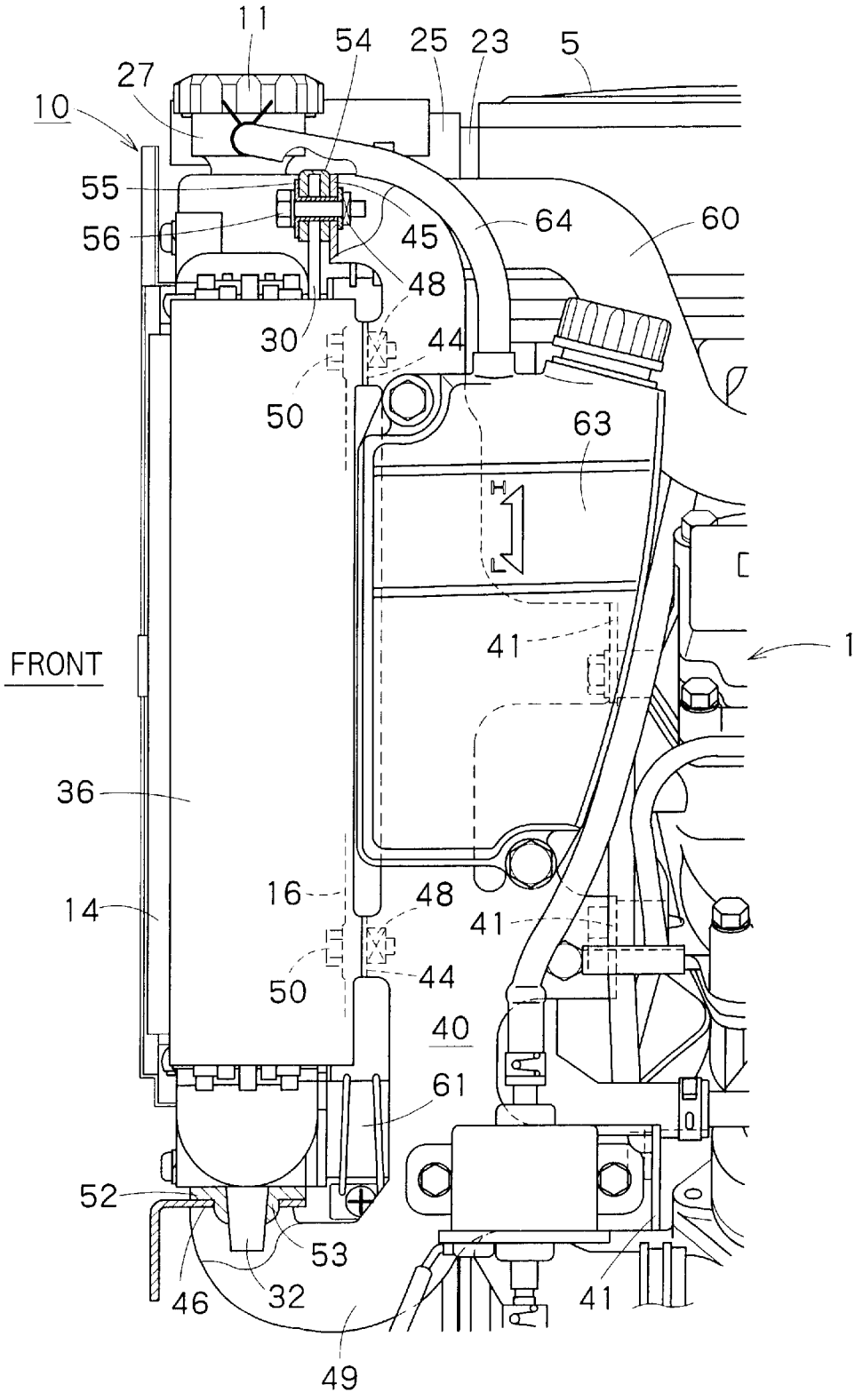
FIG. 5 is an enlarged view taken in the direction of the arrow V in FIG. 2.

FIG. 5 is an enlarged side elevation taken in the direction of the arrow V in FIG. 2 of assistance in explaining a mounting structure for mounting the radiator unit on the engine 1. As shown in FIG. 5, a curved arm 49 is formed integrally with the positioning lug 46 formed in the front lower end part of a main part of each radiator support member 40, and nuts 48 are welded to the rear surfaces of the radiator holding lug 45 and the fan shroud holding lug 44.

The fan shroud 16 is fastened to the four fan shroud holding lugs 44 of the radiator support members 40 with bolts 50. The air intake duct 25 formed integrally with the fan shroud 16 is connected to the air inlet pipe 23 of the air cleaner 5.

The radiator core 14 is fitted in a space between the right and left side walls 36 of the fan shroud 16 and is seated on damping rubber pads 52 placed on the positioning lugs 46 with the positioning pins 32 fitted through the bosses of the rubber pads 52 in positioning holes 53 formed in the positioning lugs 46. Thus the lower end part of the radiator core 14 is positioned. A damping member 54 having a U-shaped cross section is put on each upper mounting plate 30 fixed to the upper end wall of the radiator core 14, a flanged spacer 55 is inserted in the damping member 54, a bolt 56 is passed through holes formed in the spacer 55, the damping member 54 and the upper mounting plate 30, and a nut 48 is screwed on the bolt 56 to fasten the upper mounting plate 30 to the radiator holding lug 45.

A return hose 60 connects the inlet port (not shown) of the radiator core 14 provided on the upper end part thereof to the outlet port of the water jacket of the engine 1. A supply hose 61 connects an outlet port formed in a lower end part of the radiator core 14 to the inlet port of the water jacket of the engine 1. A cooling water replenishing hose 64 connects the cooling water filler tube 27 to a cooling water reserve tank 63.

A method of combining the radiator unit 10 with the engine 1 will be described hereinafter. Referring to FIG. 4, the right and left radiator support members 40 are fastened in an upright position to the front of the engine 1 with the bolts 42. Subsequently, the fan shroud 16 is disposed so as to surround the cooling fan 15 mounted on the engine 1, the intake duct 25 is connected to the air inlet pipe 23 of the air cleaner 5, and the fan shroud 16 is fastened to the fan shroud holding lugs 44 of the radiator support members 40 with the bolts 50 as shown in FIG. 3. Then, as shown in FIG. 2, the radiator core 14 is fitted in the space between the right and left side walls 36 of the fan shroud 16 with the lower end thereof seated on the damping pads 52 placed on the positioning lugs 46 and the positioning pins 32 fitted in the positioning holes 53 of the positioning lugs 46 as shown in FIG. 5. Then, the upper mounting plates 30 are fastened to the radiator holding lugs 45 of the radiator support members 40 with the bolts 56. Thus, the radiator core 14 can be fastened to the radiator core holding members 30 by bolting only the two mounting plates 30 to the radiator holding lugs 45. The work for combining the radiator core 14 with the engine 1 can be easily achieved because the radiator core 14 can be positioned by the plug-in structures each including the positioning pin 32 and the positioning lug 46 provided with the positioning hole 53 before bolting the mounting plates 30 to the radiator holding lugs 45.

Thus, the radiator core 14 can be combined with the engine 1 by the simple mounting work including fixing the radiator support members 40 to the engine 1, seating the radiator core 14 on the positioning lugs 46 of the radiator support members 40 with the positioning pins 32 fitted in the positioning holes 53 of the positioning lugs 46, and fastening the upper mounting plates 30 to the radiator holding lugs 45 of the radiator support members 40 with the bolts 56. The radiator core 14 can be easily positioned, only the two upper mounting plates 30 need to be fastened to the radiator holding lugs 45 of the radiator support members 40 with the bolts 56, and the radiator core 14 can be easily mounted on the radiator support members 40.

Since the fan shroud 16 for surrounding the cooling fan 15 mounted on the engine 1 is not fixed directly to the radiator core 14 and is fixed individually to the radiator support members 40 attached to the engine 1, the fan shroud 16 can be easily positioned and fixed to the radiator support members 40 such that an appropriate clearance is maintained between the fan shroud 16 and the cooling fan 15. Since the clearance between the fan shroud 16 and the cooling fan 15 remains constant even if the heavy radiator core 14 vibrates, noise will not be generated and the cooling fan 15 will not touch the fan shroud 16.

Since the intake duct 25 connected to the air inlet 23 of the air cleaner 5 is formed integrally with the fan shroud 16 that is fastened to the radiator support members 40 supporting the radiator core 14, the number of parts can be reduced, the fan shroud 16 and the intake duct 25 can be simultaneously mounted on the engine 1 and work for assembling the engine 1 is simplified. Since the fan shroud 16 is formed integrally with the intake duct 25, the intake duct 25 can be easily disposed close to the periphery of the radiator core 14 and can be extended to the front side of the radiator unit 10 without increasing the outside dimensions of the engine 1. Since the intake duct 25 is formed integrally with the fan shroud 16, and the intake duct 25 is disposed with the flat part 25*a* placed in a space beside the cooling water filler tube 27, the open front end of the intake duct 25 can be positioned on the front side of the radiator unit 10.

Although the invention has been described as applied to the radiator unit combined with the two-cylinder V-engine, the present invention is applicable to radiator units for various other engines including straight multicylinder engines and single-cylinder engines.

What is claimed is:

1. A radiator unit comprising:

a cooling fan fixed on a shaft supported by an engine:

a radiator support member fixed on the engine and including a radiator holding part and a fan shroud holding part;

a radiator core fastened to the radiator holding part of the radiator of the support member; and a fan shroud surrounding the cooling fan and fastened to the fan shroud holding part of the radiator support member;

wherein the radiator holding part of the radiator support member includes: a lower end part that is fixed to a lower end part of the radiator core by a plug-in structure including a positioning pin and a positioning hole; and an upper end part that is fixed to the upper end part of the radiator core with a bolt.

2. The radiator unit according to claim 1, further comprising an intake duct formed integrally with the fan shroud, wherein a rear end part of the intake duct is connected to an air inlet of an air filter mounted on the engine, whereas a front end part of the intake duct extends over an upper end wall of the radiator core and opens toward the front.

3. The radiator unit according to claim 2, wherein the intake duct includes a flat part extending over the upper end wall of the radiator core.

4. The radiator unit according to claim 1, wherein the lower end part of the radiator core is fixed to the lower end part of the radiator holding part of the radiator support member through a damping member.

5. The radiator unit according to claim 1, wherein the upper end part of the radiator core is fixed to the upper end part of the radiator holding part of the radiator support member through a damping member.

6. The radiator unit according to claim 5, wherein the upper end part of the radiator holding part of the radiator support member includes a holding surface facing the front, against which the upper end part of the radiator core abuts from the front.

7. The radiator unit according to claim 1, wherein the fan shroud includes a pair of sidewalls extending forward on opposite sides of the radiator core.

* * * * *